US007889047B2

(12) United States Patent
Yang et al.

(10) Patent No.: US 7,889,047 B2
(45) Date of Patent: Feb. 15, 2011

(54) MAGNETIC DEVICE

(75) Inventors: Chung-Jung Yang, Taoyuan Hsien (TW); Chuan-Yuan Kung, Taoyuan Hsien (TW); Man-Mei Chen, Taoyuan Hsien (TW); Po-Jen Tsai, Taoyuan Hsien (TW)

(73) Assignee: Delta Electronics Inc., Taoyuan Hsien (TW)

( * ) Notice: Subject to any disclaimer, the term of this patent is extended or adjusted under 35 U.S.C. 154(b) by 21 days.

(21) Appl. No.: 12/052,388

(22) Filed: Mar. 20, 2008

(65) Prior Publication Data

US 2009/0160596 A1 Jun. 25, 2009

(30) Foreign Application Priority Data

Dec. 19, 2007 (TW) ..... 96148596 A

(51) Int. Cl.
*H01F 27/28* (2006.01)

(52) U.S. Cl. ..... 336/229

(58) Field of Classification Search ..... 336/65, 336/200, 225, 229, 232
See application file for complete search history.

(56) References Cited

U.S. PATENT DOCUMENTS

| | | | | | |
|---|---|---|---|---|---|
| 4,103,267 | A * | 7/1978 | Olschewski | ..... | 336/65 |
| 4,536,733 | A * | 8/1985 | Shelly | ..... | 336/182 |
| 4,754,250 | A * | 6/1988 | Duin | ..... | 336/65 |
| 4,777,465 | A * | 10/1988 | Meinel | ..... | 336/65 |
| 5,430,613 | A * | 7/1995 | Hastings et al. | ..... | 361/760 |
| 5,543,773 | A * | 8/1996 | Evans et al. | ..... | 336/183 |
| 5,929,735 | A * | 7/1999 | Heinrich | ..... | 336/61 |
| 6,188,305 | B1 * | 2/2001 | Chang et al. | ..... | 336/200 |
| 6,998,952 | B2 * | 2/2006 | Zhou et al. | ..... | 336/200 |
| 7,009,486 | B1 * | 3/2006 | Goeke et al. | ..... | 336/229 |

* cited by examiner

*Primary Examiner*—Tuyen Nguyen
(74) *Attorney, Agent, or Firm*—Muncy, Geissler, Olds & Lowe, PLLC

(57) ABSTRACT

A magnetic device includes a circuit board, a magnetic induction element, an insulating structure and a plurality of conductive wire segments. The circuit board has at least one conductive layer. The magnetic induction element is disposed on the circuit board. The insulating structure covers the magnetic induction element. The insulating structure is wound by the conductive wire segments. Two ends of each conductive wire segments are electrically connected to the conductive layer to form a coil loop.

18 Claims, 11 Drawing Sheets

2

2

3

5

6

7

MAGNETIC DEVICE

CROSS REFERENCE TO RELATED APPLICATIONS

This Non-provisional application claims priority under 35 U.S.C. §119(a) on Patent Application No(s). 096148596 filed in Taiwan, Republic of China on Dec. 19, 2007, the entire contents of which are hereby incorporated by reference.

BACKGROUND OF THE INVENTION

1. Field of Invention

The present invention relates to a magnetic device such as an inductor, a filter or a transformer.

2. Related Art

Taking the conventional inductor as an example, it is usually made by directly winding an enameled wire on a material with the magnetic induction property. When the current is applied to the inductor, the inductance can be obtained. As shown in FIG. 1, a conventional inductor 1 includes an insulating housing 11, an iron core 12 and two enameled wires 13. The iron core 12 is an annular iron core, and the insulating housing 11 covers the iron core 12. The enameled wires 13 are wound on the iron core 12 by hand or machine.

In the conventional winding method, the enameled wires 13 are usually wound repeatedly and repeatedly so as to obtain larger inductance. However, this may scratch the insulating layer of the enameled wires 13. In addition, the winding distribution of the wires may be non-uniform due to the different winding methods and directions. Therefore, the stray capacitance of the inductor becomes uncontrollable, which results in the increasing variation of noise restraining ability between the coils with the same specification. In addition, after winding the enameled wires 13, the ends of the enameled wires 13 are usually pulled to make the enameled wires 13 more tightly fit on the iron core 12. Accordingly, the redundant portions of the enameled wires 13 must be waived. Moreover, the conventional winding method needs much manufacturing time, so that the manufacturing cost is increased.

SUMMARY OF THE INVENTION

In view of the foregoing, it is an object of the present invention to provide a magnetic device, which has a plurality of conductive wire segments instead of the conventional single wire. The conductive wire segments are electrically connected to a circuit board to form the coil loop, so that the winding procedure can be hastened and the redundant wasted enameled wire can be avoided so as to reduce the manufacturing cost.

In addition, it is another object of the present invention to provide a magnetic device that can control the winding distribution, direction and density thereof so as to eliminate the winding variation without effecting the product property, and thus to reduce the affection thereof caused by noise.

Moreover, it is further another object of the present invention to provide a magnetic device that can utilize the automatic manufacturing process to electrically connect a plurality of conductive wire segments on a circuit board so as to form the coil loop.

To achieve the above, the present invention discloses a magnetic device including a circuit board, a magnetic induction element, an insulating structure and a plurality of conductive wire segments. The circuit board has at least one conductive layer. The magnetic induction element is disposed on the circuit board. The insulating structure covers the magnetic induction element. The insulating structure is wound by the conductive wire segments. The ends of each conductive wire segments are electrically connected to the conductive layer to form a coil loop.

As mentioned above, the magnetic device of the present invention includes a plurality of conductive wire segments instead of the conventional single wire. The conductive wire segments are wound around the magnetic induction element and the insulating structure, and the ends of the conductive wire segments are electrically connected to the conductive layer of the circuit board to form a coil loop. Compared with the prior art, the present invention can carry out the automatic manufacturing process for speeding up the winding step and can exactly use the predetermined length of the conductive wire segments, which can avoid the redundant wasted wire so as to decrease the manufacturing cost. In addition, the present invention can control the winding distribution, direction and density of the magnetic device so as to eliminate the winding variation, which effects the product property, and thus to reduce the affection of the magnetic device caused by noise.

BRIEF DESCRIPTION OF THE DRAWINGS

The present invention will become more fully understood from the subsequent detailed description and accompanying drawings, which are given by way of illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

The present invention discloses a magnetic device including a circuit board, a magnetic induction element, an insulating structure and a plurality of conductive wire segments. The magnetic device can be an inductor, a filter or a transformer. To make the present invention more comprehensive, several embodiments of an inductor, especially a composite inductor, will be described herein below.

First Embodiment

Figure 1:
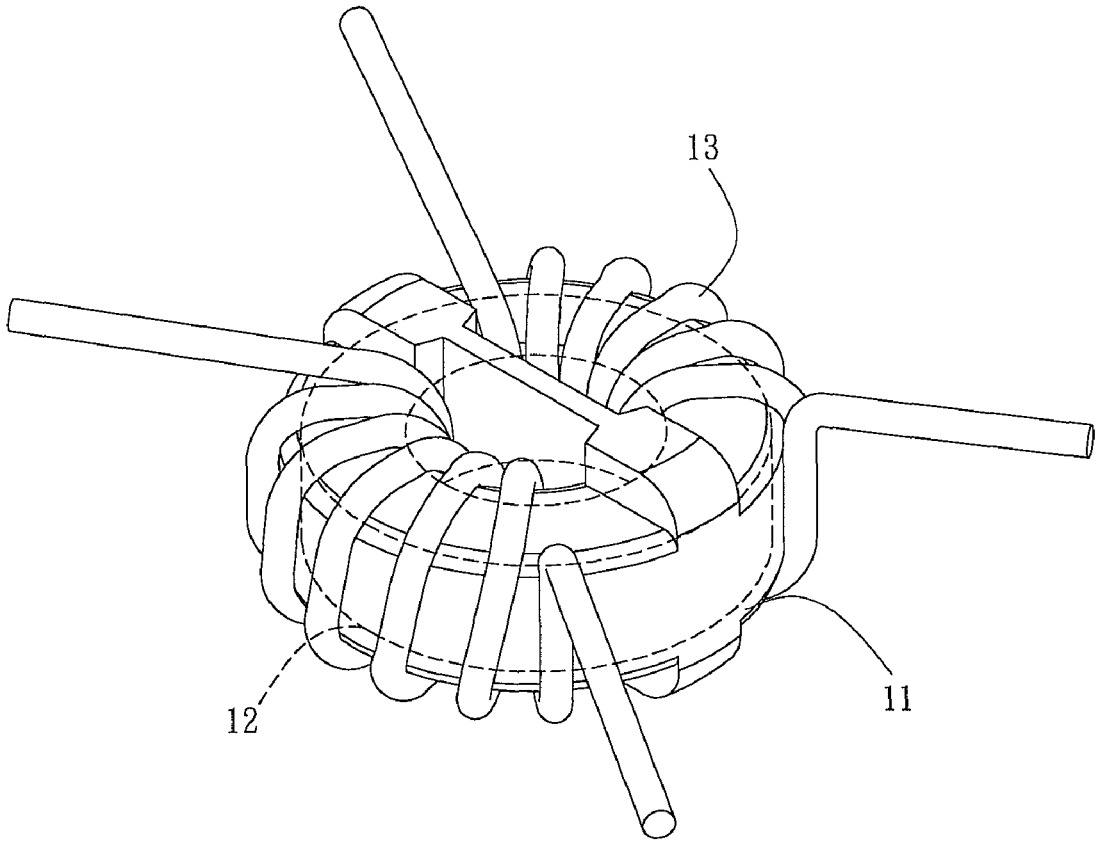
FIG. 1(PRIOR ART)
FIG. 1 is a schematic illustration showing a conventional inductor.
Figure 2A:
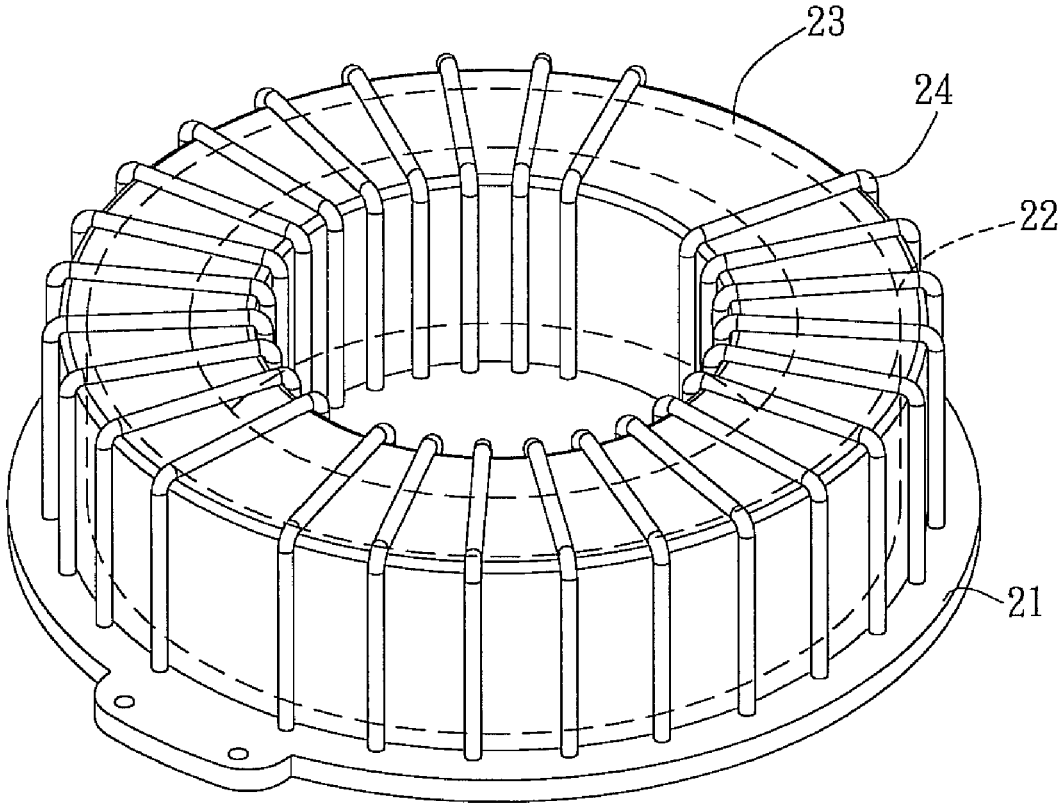
FIG. 2A is a schematic illustration showing a composite inductor according to a first embodiment of the present invention.
Figure 2B:
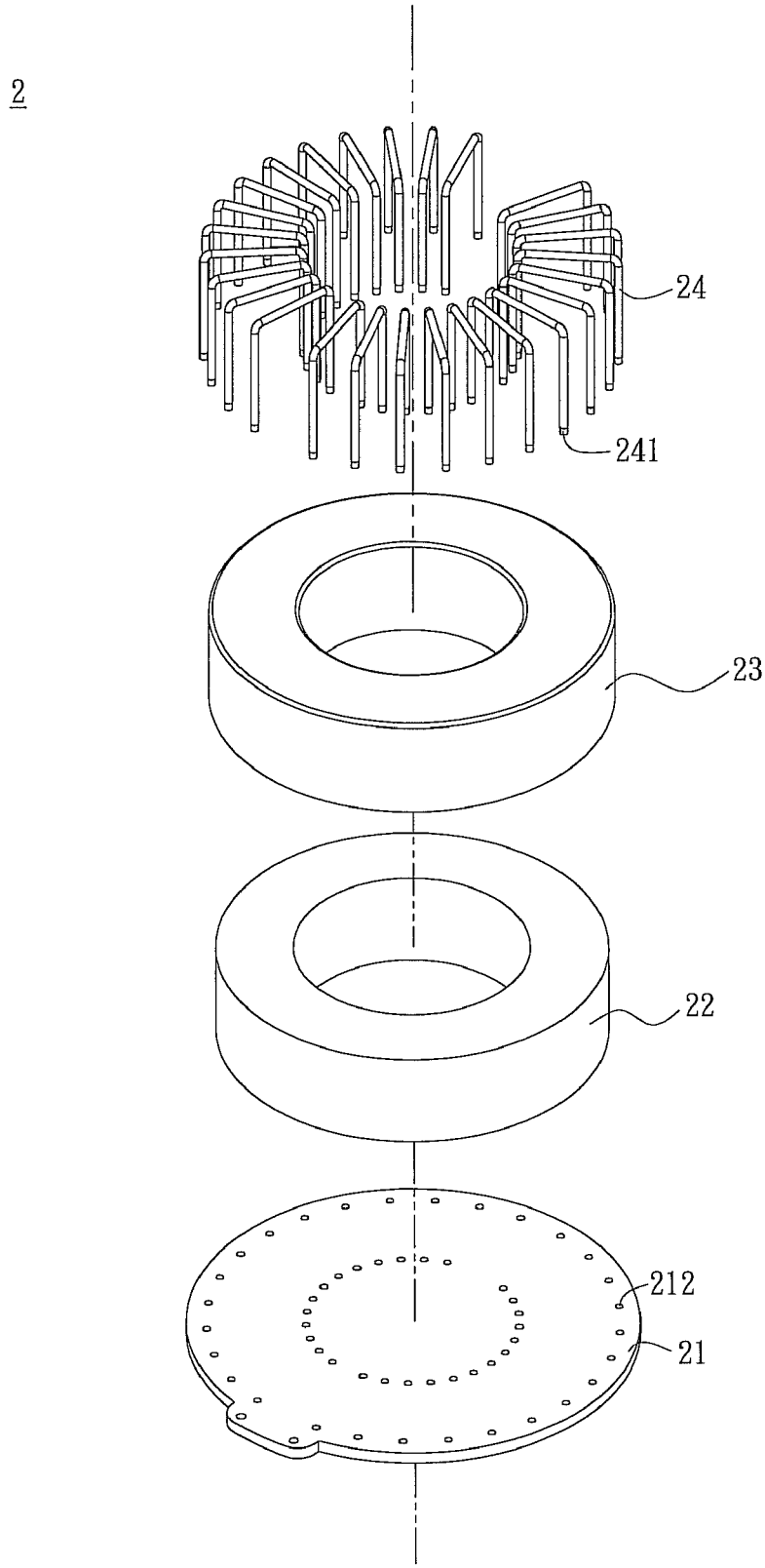
FIG. 2B is an exploded view of the composite inductor of FIG. 2A.
Figure 2C:
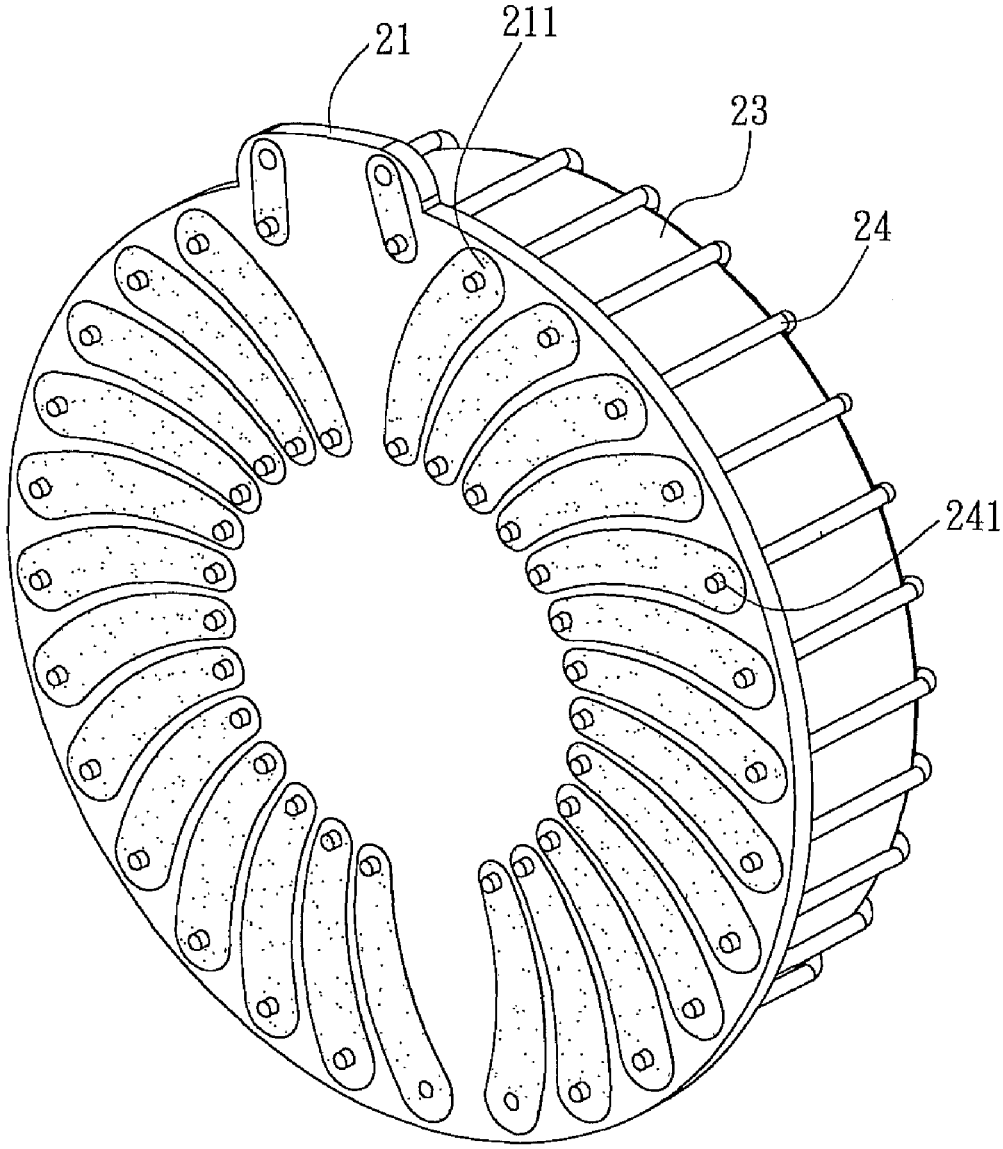
FIG. 2C is a bottom view of the composite inductor of FIG. 2A.

With reference to FIGS. 2A to 2D, a composite inductor 2 according to a first embodiment of the present invention includes a circuit board 21, a magnetic induction element 22, an insulating structure 23 and a plurality of conductive wire segments 24. The circuit board 21 can be a printed circuit board and includes at least one conductive layer 211 as shown in FIG. 2C. The material of the conductive layer 211 includes gold, silver, copper, tin or alloys thereof. In the embodiment, the conductive layer 211 is, for example but not limited to, a copper layer.

For example, the magnetic induction element 22 is annular, elliptic or rectangular, and the material of the magnetic induction element 22 includes iron, cobalt, nickel or alloys thereof. In the embodiment, the magnetic induction element 22 is an annular iron core and is disposed on the circuit board 21. The insulating structure 23 is, for example but not limited to, an insulating housing for covering the magnetic induction element 22 partially or completely for isolating the magnetic induction element 22 from the conductive wire segments 24. Alternatively, the insulating structure 23 can be an insulating layer, which is composed of an insulating material and formed on the surface of the magnetic induction element 22.

The material of the conductive wire segments 24 includes gold, silver, copper, tin or alloys thereof. In the embodiment, the conductive wire segments 24 can be, for example, an enameled wire segments and are disposed around the insulating structure 23. To be noted, the conductive wire segments 24 can be designed corresponding to the insulating structure 23, so that the shape of the cross-section of the conductive wire segments 24 can be circular, elliptic or rectangular.

Figure 2D:
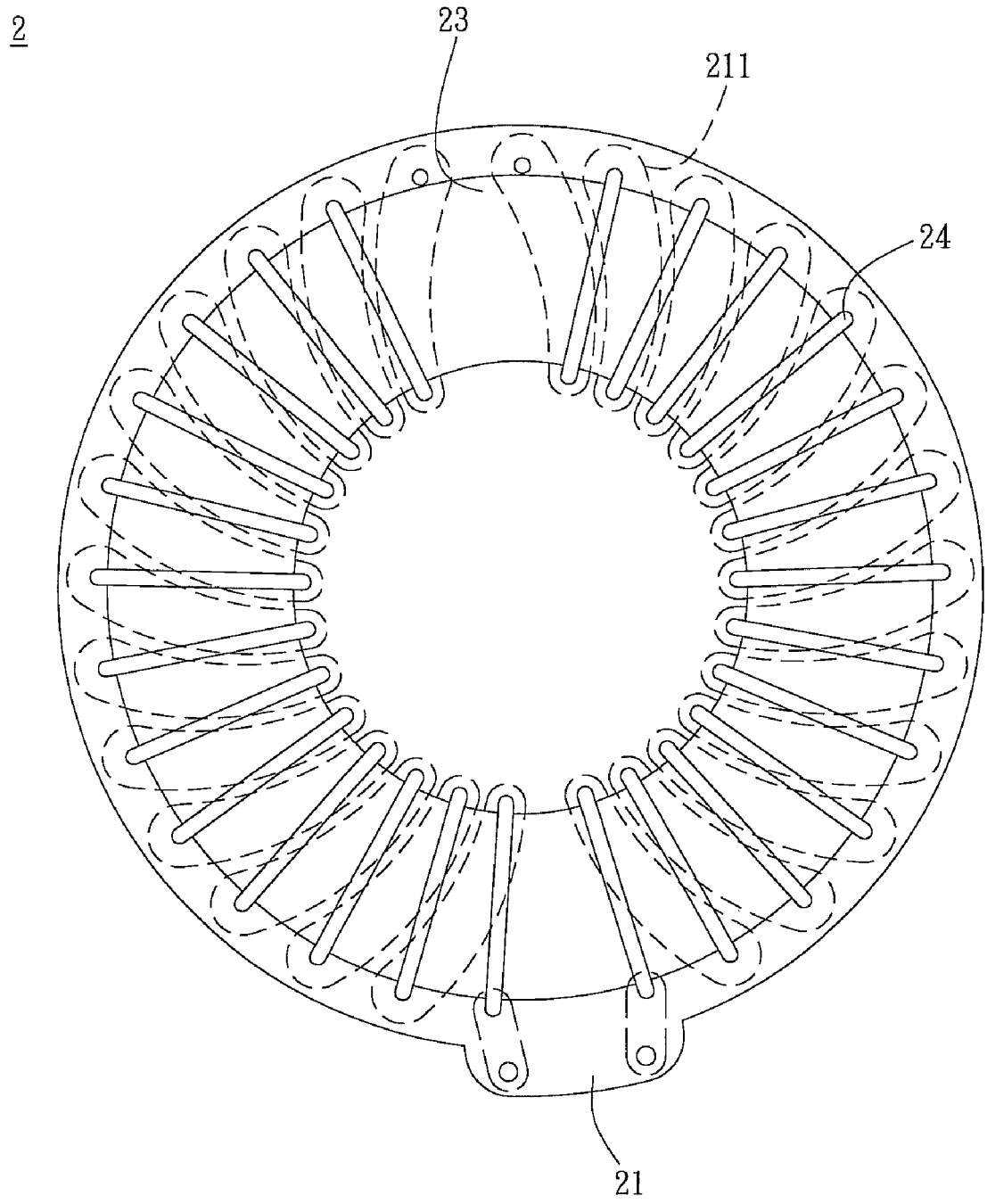
FIG. 2D is a top view of the composite inductor of FIG. 2A.

Referring to FIGS. 2B to 2D, the assembling procedure of the composite inductor 2 will be described hereinafter. Firstly, an annular magnetic induction element 22 is disposed on a circuit board 21, which has a plurality of conductive vias 212. Next, an insulating structure 23, which has a shape substantially equivalent to that of the magnetic induction element 22, is provided to cover the magnetic induction element 22. Then, the conductive wire segments 24 are disposed around the insulating structure 23 by, for example, a machine. Each end 241 of each conductive wire segment 24 is inserted into one corresponding conductive via 212. Finally, the conductive layer 211, such as a copper layer, of the circuit board 21 is electrically connect the ends 241 of two adjacent conductive wire segments 24 so as to form a coil as shown in FIGS. 2C and 2D. Accordingly, the assembling of the composite inductor 2 can be finished. As mentioned above, the present invention can be carried out by automatic winding for speeding up the winding step. In addition, the predetermined length of the conductive wire segments 24 can be exactly used, so that the redundant wasted wire can be avoided so as to decrease the manufacturing cost. Furthermore, since the winding distribution, direction and density of the composite inductor can be controlled according to the actual needs, the winding variation, which affects the product property, can be eliminated, so that the properties of the composite inductor of the present invention can have the same or similar properties.

Second Embodiment

Figure 3:
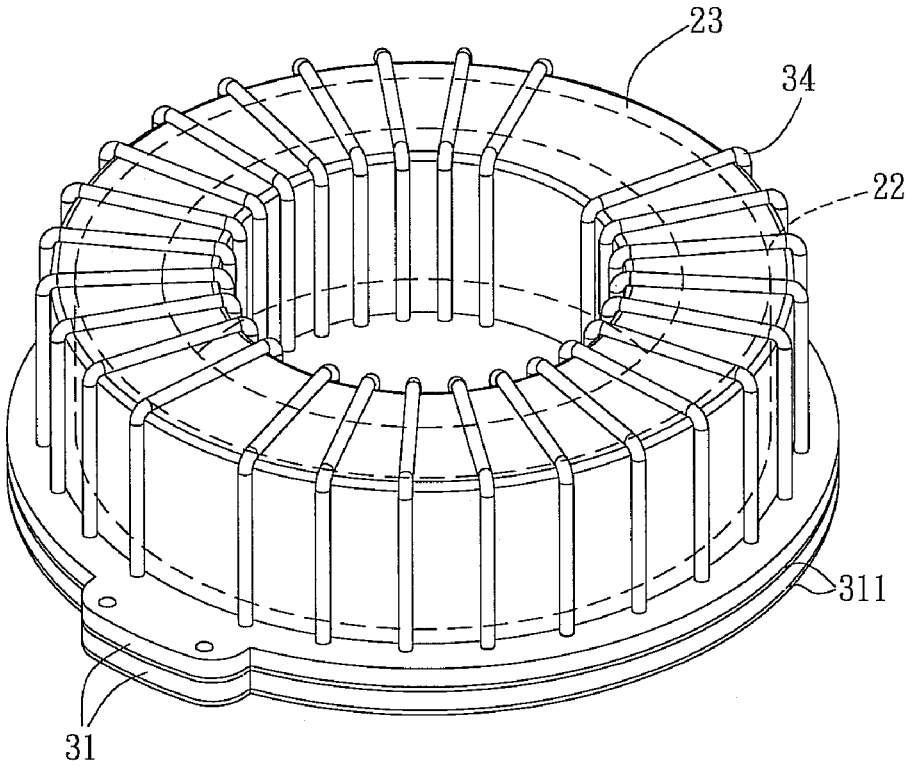
FIG. 3 is a schematic illustration showing a composite inductor according to a second embodiment of the present invention.

With reference to FIG. 3, a composite inductor 3 according to a second embodiment of the present invention includes a circuit board 31, a magnetic induction element 22, an insulating structure 23 and a plurality of conductive wire segments 34.

The different between the composite inductors 2 and 3 is in that the conductive wire segments 34 of the composite inductor 3 are disposed on the circuit board 31, which has a plurality of conductive layers 311. In the embodiment, two ends of each conductive wire segment can be disposed on different conductive layers, respectively (not shown). The conductive wire segments 34 are electrically connected to the conductive layers 311 to form a coil. Accordingly, the current durability of the composite inductor 3 can be increased by the increased area of the total conductive layers 311.

Third Embodiment

Figure 4:
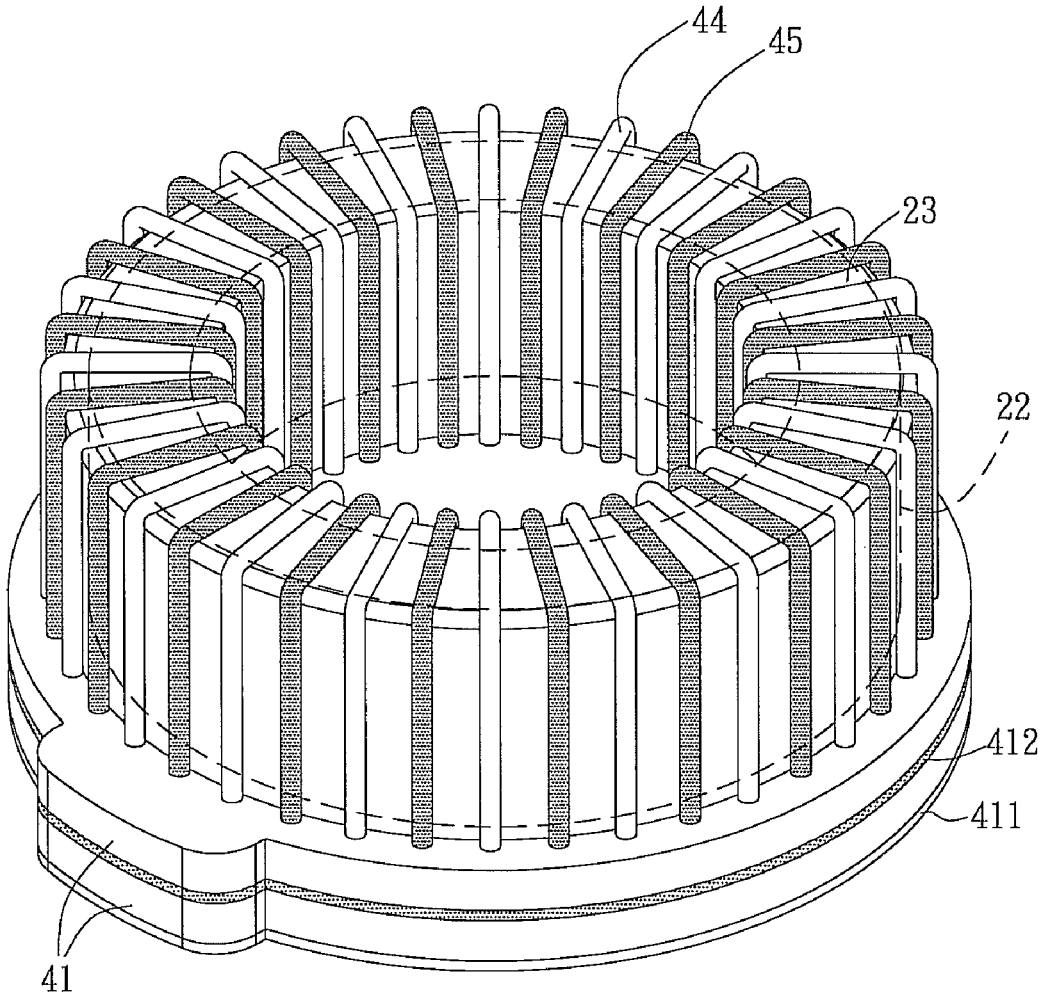
FIG. 4 is a schematic illustration showing a composite inductor according to a third embodiment of the present invention.

With reference to FIG. 4, a composite inductor 4 according to a third embodiment of the present invention includes a circuit board 41, a magnetic induction element 22, an insulating structure 23, a plurality of conductive wire segments 44 and a plurality of conductive wire segments 45.

The difference between the composite inductors 4 and 2 is in that the conductive wire segments 44 and 45 of the composite inductor 4 are disposed on the circuit board 41, which has a plurality of conductive layers 411 and 412. In the embodiment, the number of the conductive wire segments 44 is the same as that of the conductive wire segments 24 of the first embodiment, and the conductive wire segments 45 are newly added. The conductive wire segments 411 and 412 are connected to each other through at least one via (not shown), so that the conductive wire segments 44 and 45 can be electrically connected to the conductive layers 411 and 412 so as to form a coil. Accordingly, the winding density can be doubled, thereby increasing the inductance of the composite inductor 4.

Fourth Embodiment

Figure 5A:
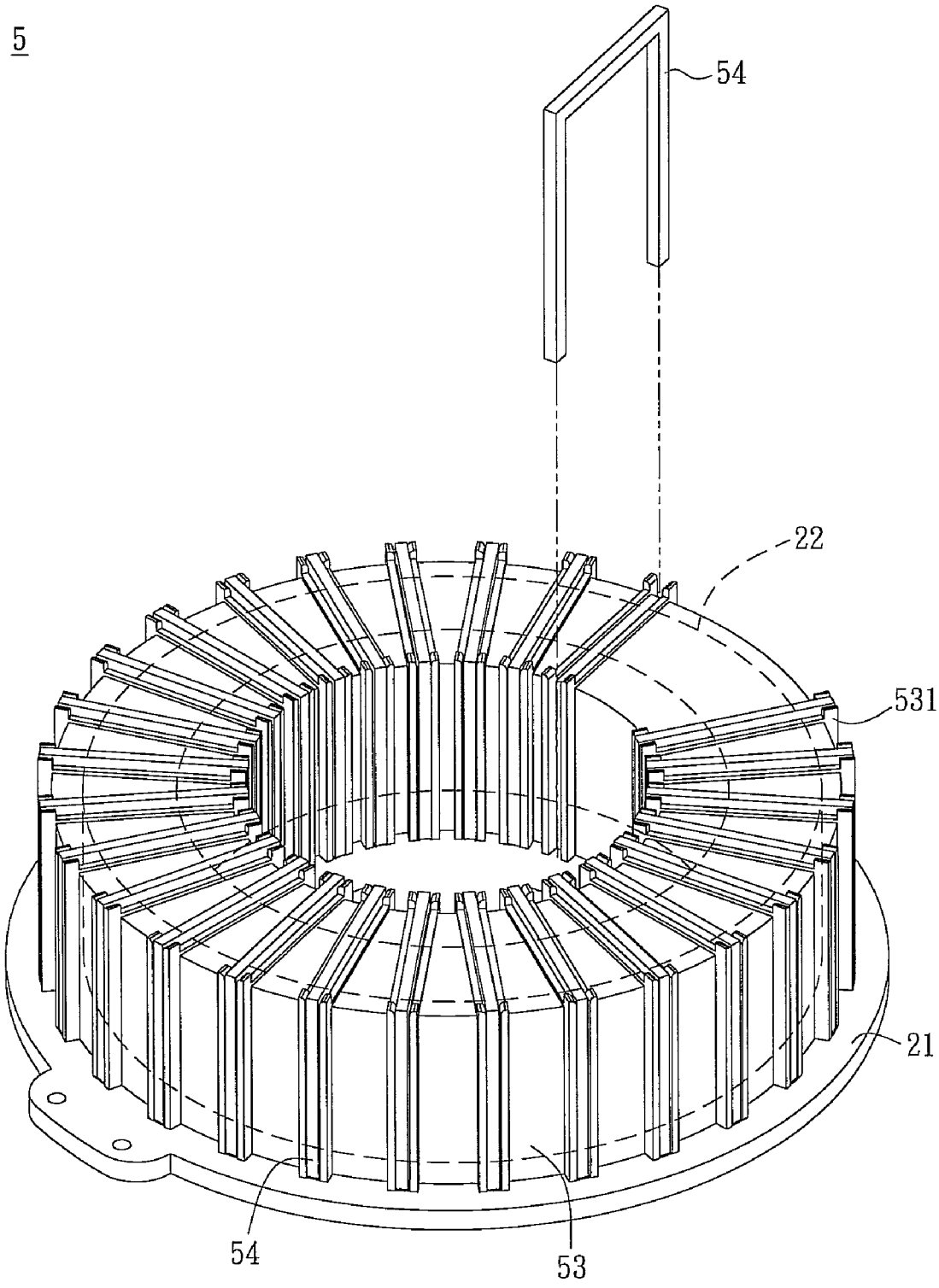
FIGS. 5A and 5B are schematic illustrations showing a composite inductor according to a fourth embodiment of the present invention.
Figure 5B:
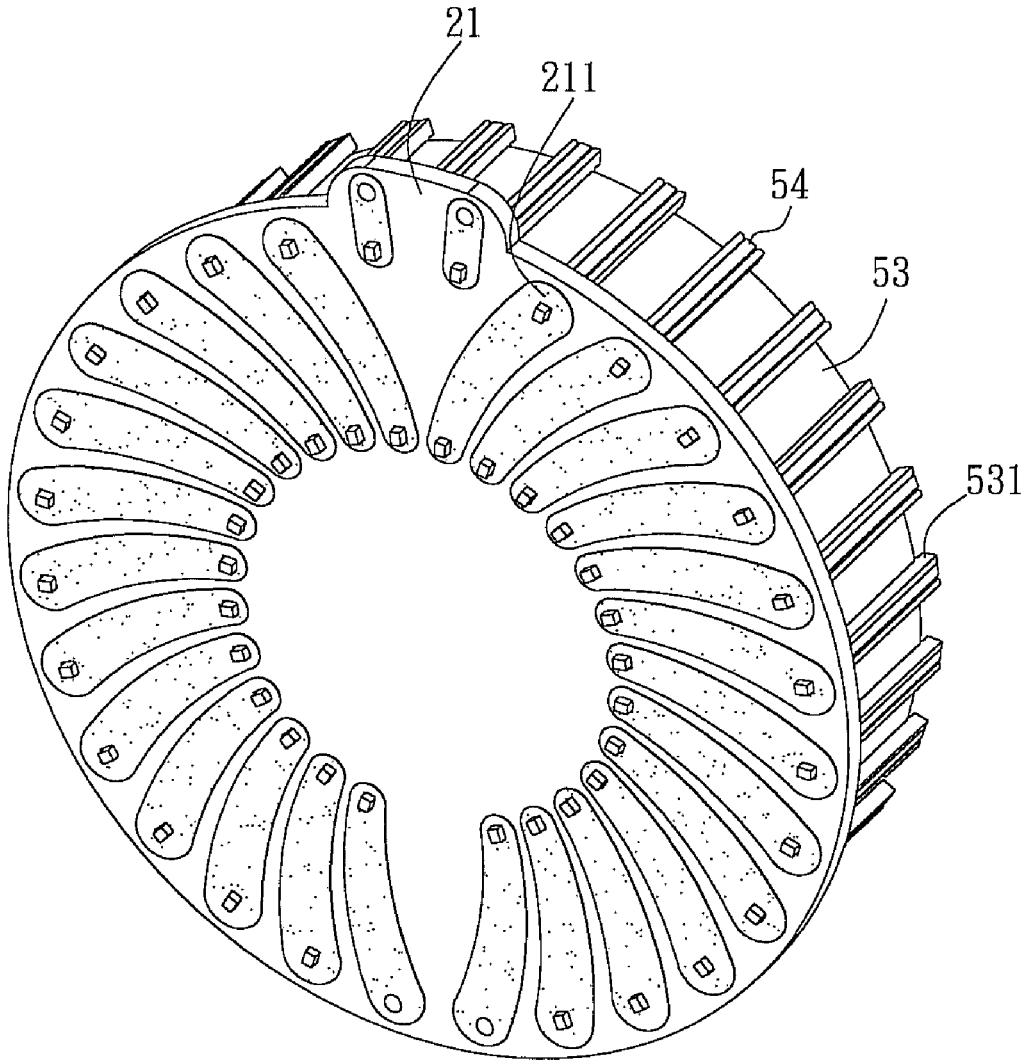

With reference to FIGS. 5A and 5B, a composite inductor 5 according to a fourth embodiment of the present invention includes a circuit board 21, a magnetic induction element 22, an insulating structure 53 and a plurality of conductive wire segments 54.

The difference between the composite inductors 5 and 2 is in that the insulating structure 53 has a plurality of insulating recesses 531 disposed at the outer edge of the insulating housing thereof. The conductive wire segments 54 are disposed in the insulating recesses 531, respectively. To be noted, the conductive wire segments 54 have the structure corresponding to the insulating recesses 531. For example, the cross-section of the conductive wire segments 54 can be rectangular and preferably be flat, so that the conductive wire segments 54 can be disposed and fixed in the insulating recesses 531. This can ensure the insulation between the conductive wire segments 54.

Fifth Embodiment

Figure 6:
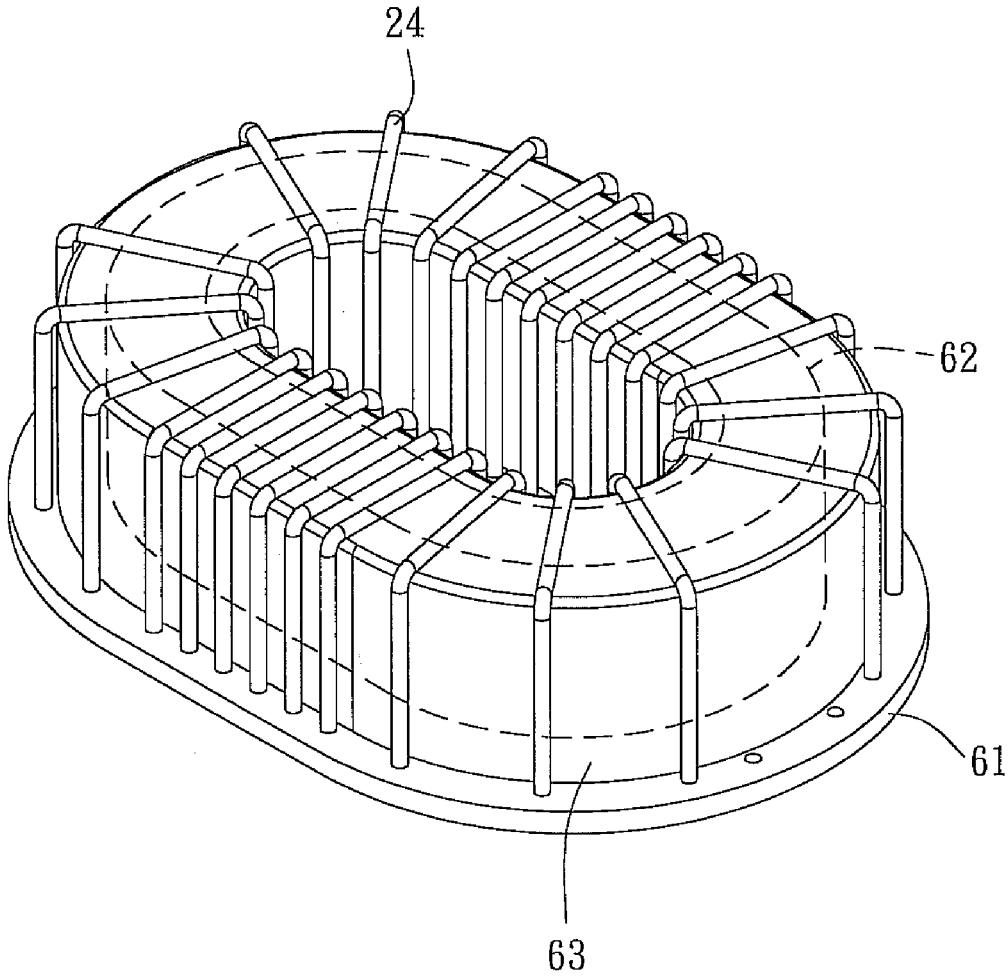
FIG. 6 is a schematic illustration showing a composite inductor according to a fifth embodiment of the present invention.

With reference to FIG. 6, a composite inductor 6 according to a fifth embodiment of the present invention includes a circuit board 61, a magnetic induction element 62, an insulating structure 63 and a plurality of conductive wire segments 24.

The difference between the composite inductors 6 and 2 is in that the shapes of the magnetic induction element 62 and the insulating structure 63 are substantially the same. In this embodiment, the magnetic induction element 62 and the insulating structure 63 are both elliptic. In addition, the circuit board 61 can be corresponding to the shapes of the magnetic induction element 62 and the insulating structure 63 to be elliptic or any other shapes.

Sixth Embodiment

Figure 7:
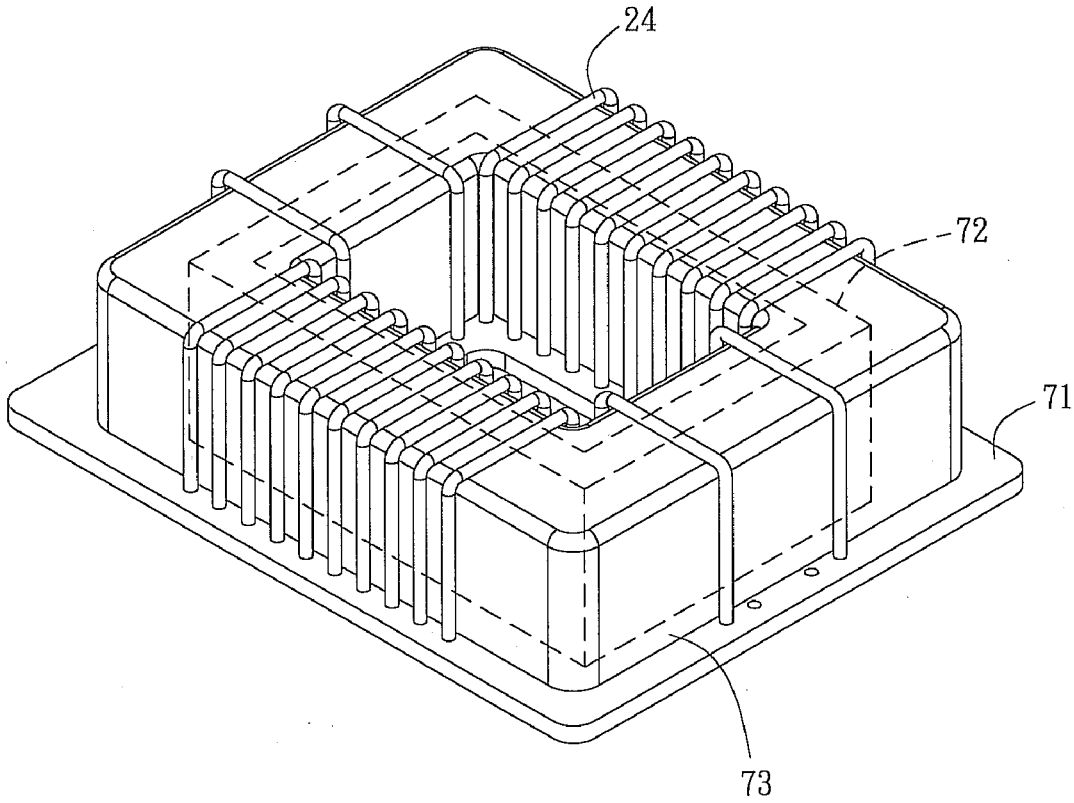
FIG. 7 is a schematic illustration showing a composite inductor according to a sixth embodiment of the present invention.

With reference to FIG. 7, a composite inductor 7 according to a sixth embodiment of the present invention includes a circuit board 71, a magnetic induction element 72, an insulating structure 73 and a plurality of conductive wire segments 24.

The difference between the composite inductors 7 and 6 is in that the shapes of the magnetic induction element 72 and the insulating structure 73 are substantially the same and are both rectangular. In addition, the circuit board 71 can be corresponding to the shapes of the magnetic induction element 72 and the insulating structure 73 to be rectangular or any other shapes.

To be noted, the number of the conductive layers of the circuit board and the shape of the circuit board, magnetic induction element, insulating structure and conductive wire segment of the above-mentioned composite inductors can be changed for satisfying the actual needs.

In summary, the magnetic device, such as the above-mentioned composite inductor, of the present invention includes a plurality of conductive wire segments instead of the conventional single wire. The conductive wire segments are wound around the magnetic induction element and the insulating structure, and the ends of the conductive wire segments are electrically connected to the conductive layer of the circuit board to form the coil. Compared with the prior art, the present invention can be carried out by the automatic manufacturing process for speeding up the winding step and can exactly use the predetermined length of the conductive wire segments, which can avoid the redundant wasted wire so as to decrease the manufacturing cost. In addition, the present invention can control the winding distribution, direction and density of the magnetic device so as to eliminate the winding variation, which effects the product property, and thus to reduce the affection of the magnetic device caused by noise.

Although the present invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present invention.

What is claimed is:

1. A magnetic device comprising:

a circuit board having at least one conductive layer;

a magnetic induction element disposed on the circuit board;

a plurality of conductive, non-printed wire segments winding around the magnetic induction element, wherein two ends of each of the conductive wire segments are electrically connected to the conductive layer so as to form a coil; and an insulating structure isolating the magnetic induction element from the conductive wire segments;

wherein the circuit board has a plurality of conductive vias, and the ends of the conductive wire segments are inserted into the corresponding vias, respectively, so as to form the coil.

2. The magnetic device according to claim 1, wherein the insulating structure is an insulating housing for covering the magnetic induction element partially or completely.

3. The magnetic device according to claim 2, wherein the insulating housing comprises a plurality of insulating recesses disposed at an outer edge thereof for allowing the conductive wire segments to be disposed therein, respectively.

4. The magnetic device according to claim 1, wherein the insulating structure is an insulating layer for covering the magnetic induction element.

5. The magnetic device according to claim 1, wherein the magnetic induction element is circular, elliptic or rectangular.

6. The magnetic device according to claim 1, wherein a shape of the circuit board corresponds to that of the magnetic induction element and the insulating structure to be circular, elliptic or rectangular.

7. The magnetic device according to claim 1, wherein a shape of the cross-section of the conductive wire segments is circular, elliptic, rectangular or flat.

8. The magnetic device according to claim 1, wherein the conductive wire segments are enameled wire segments.

9. The magnetic device according to claim 1, wherein the circuit board is a multilayer circuit board with a plurality of conductive layers.

10. The magnetic device according to claim 9, wherein ends of alternate ones of the conductive wire segments are disposed on different conductive layers of the multilayer circuit board, respectively.

11. The magnetic device according to claim 9, wherein the conductive layers are connected to each other by at least one conductive via.

12. The magnetic device according to claim 1, wherein a material of the conductive layer comprises gold, silver, copper, tin or alloys thereof.

13. The magnetic device according to claim 1, wherein a material of the conductive wire segments comprises gold, silver, copper, tin or alloys thereof.

14. The magnetic device according to claim 1, wherein a material of the magnetic induction element comprises iron, cobalt, nickel or alloys thereof.

15. The magnetic device according to claim 1, wherein the magnetic induction element is an iron core.

16. The magnetic device according to claim 1, wherein the magnetic device is an inductor, a filter or a transformer.

17. A magnetic device comprising:

a circuit board having at least one conductive layer;

a magnetic induction element disposed on the circuit board;

a plurality of conductive wire segments winding around the magnetic induction element, wherein two ends of each of the conductive wire segments are electrically connected to the conductive layer so as to form a coil; and an insulating structure isolating the magnetic induction element from the conductive wire segments, wherein the insulating structure has a containing space for covering the magnetic induction element partially or completely.

18. A magnetic device comprising:

a circuit board having at least one conductive layer;

a magnetic induction element disposed on the circuit board;

a plurality of conductive wire segments winding around the magnetic induction element, wherein two ends of each of the conductive wire segments are electrically connected to the conductive layer so as to form a coil; and an insulating structure isolating the magnetic induction element from the conductive wire segments, wherein the circuit board has a plurality of conductive vias, and the ends of the conductive wire segments are inserted into the corresponding vias, respectively, so as to form the coil.

* * * * *